US008162142B2

(12) United States Patent
Kobayashi

(10) Patent No.: US 8,162,142 B2
(45) Date of Patent: Apr. 24, 2012

(54) PACKAGE FOR PAPER SLIP STACK

(75) Inventor: Isao Kobayashi, Nerima-ku (JP)

(73) Assignee: Fuji Paper Chemical Co., Ltd., Kochi (JP)

( * ) Notice: Subject to any disclaimer, the term of this patent is extended or adjusted under 35 U.S.C. 154(b) by 16 days.

(21) Appl. No.: 12/812,631

(22) PCT Filed: Jan. 9, 2009

(86) PCT No.: PCT/JP2009/050190

§ 371 (c)(1),
(2), (4) Date: Jul. 13, 2010

(87) PCT Pub. No.: WO2009/090911

PCT Pub. Date: Jul. 23, 2009

(65) Prior Publication Data

US 2010/0288666 A1 Nov. 18, 2010

(30) Foreign Application Priority Data

Jan. 18, 2008 (JP) ..... 2008-009885

(51) Int. Cl.
*B65D 73/00* (2006.01)

(52) U.S. Cl. ..... 206/494; 206/449; 206/812

(58) Field of Classification Search ..... 206/233, 206/449, 494, 460, 812, 205; 221/45, 63; 229/87.05

See application file for complete search history.

(56) References Cited

U.S. PATENT DOCUMENTS

| | | | | |
|---|---|---|---|---|
| 2,025,969 | A * | 12/1935 | Broeren | 206/494 |
| 3,124,298 | A * | 3/1964 | Repko | 206/449 |
| 4,192,420 | A * | 3/1980 | Worrell et al. | 206/205 |
| 5,531,325 | A * | 7/1996 | Deflander et al. | 206/494 |
| 5,540,354 | A * | 7/1996 | Annand | 206/449 |
| 6,880,704 | B2 * | 4/2005 | Bredahl | 206/494 |
| 6,964,349 | B2 * | 11/2005 | Sears et al. | 206/494 |
| 7,695,037 | B2 * | 4/2010 | Rhodes | 294/156 |
| 2002/0112982 | A1 * | 8/2002 | Stagray et al. | 206/494 |

FOREIGN PATENT DOCUMENTS

| | | |
|---|---|---|
| JP | 56-68605 | 6/1981 |
| JP | 4-45494 | 4/1992 |
| JP | 7-194498 | 8/1995 |
| JP | 8-26333 | 1/1996 |
| JP | 2006-311872 | 11/2006 |

OTHER PUBLICATIONS

International Search Report issued Mar. 31, 2009 in International (PCT) Application No. PCT/JP2009/050190.

* cited by examiner

*Primary Examiner* — Luan K Bui

(74) *Attorney, Agent, or Firm* — Wenderoth, Lind & Ponack, LLP

(57) ABSTRACT

A package for a paper slip stack, which can steadily and stably store the paper slip stack bundled by a packaging sheet and can be easily released from the packaging sheet after being contained in a paper holder. The paper slip stack is formed by alternately interlocking half parts (5*a* and 5*b*) of twofold paper slips (5) with one another oppositely in their folded directions so as to stack the paper slips in piles in their mutually interconnected state. The slips are bundled by a packaging sheet (3) which is provided with a tab (4) that protrudes outward from one side of the paper slip stack. A frangible part is formed anywhere in a longitudinal direction of the packaging sheet so as to be broken or cut by a tensioning force produced by pulling the tab.

10 Claims, 9 Drawing Sheets

PACKAGE FOR PAPER SLIP STACK

BACKGROUND OF THE INVENTION

1. Technical Field

The present invention relates to a package for packing a stack of paper slips.

2. Description of the Related Art

There is a stack of paper slips (hereinafter referred to as 'paper slip stack') which are interfolded and interconnected in such a layered state that lots of twofold paper slips alternately interlock each other oppositely in their folded directions so as to allow half parts of the paper slips to overlap each other. As an example of such a paper slip stack, there may be enumerated a stack of tissue paper, paper towels, and cold paper.

Taking the cold paper for instance, as is well known, this paper is used for trussing hair in getting the hair permed at a hairdressing salon and elsewhere. A large number of cold papers are commonly used in one operation, and are thus contained in a case or paper holder so as to be refilled when used up.

A refillable paper slip stack, such as of cold paper as stated above, is made by bundling many slips of paper and previously contained in a pile and must be somehow bundled when being stored to be kept in the stacked state. Such being the case, the bundled paper slips can become undone when inserted into the paper holder, but the cold paper is problematic because each cold paper is lightweight and difficult to hold, and thus likely to come loose while undoing.

FIG. 15 is illustrative of a procedure for handling a conventional package for a paper slip stack. The paper slip stack 100 is bundled with a packaging sheet 110 such as of paper or film so as to prevent the stack from separating before refilling the paper holder 120 with the slip stack of papers. Thus, the paper slip stack is placed in the paper holder 120 while being held with fingertips upon cutting the packaging sheet 110 with scissors or the like. At this time, it is common to disarrange the paper slip stack due to the irksome task of putting the slip of papers into a paper holder of small size or disturb an appropriate work for refilling in closing a lid 121 because of the disarranged paper slip stack. In a case where the paper holder 120 is provided with a lifting plate 122 having a spring in order to make it easier to pull the paper slip out of the holder 120. Thus, the paper slip stack has to be forced into the holder against the energizing force of the spring, and is consequently at an increased risk of being disarranged and separated. As a result, the task of placing the paper slip stack into the paper holder becomes even more cumbersome.

The paper slips thus contained in the paper holder cannot be pulled out of the paper holder unless a little portion of a paper slip emerges from a paper drawing mouth of the paper holder when used. Therefore, it is necessary to preliminarily extend out a part of the uppermost paper slip with the user's fingers to allow the paper slip to be pulled out of the paper holder at the time of placing the paper slip stack into the paper holder.

SUMMARY OF INVENTION

1. Problems to be Solved by the Invention

As described above, the conventional packaging sheet makes it possible to bundle the paper slip stack, but it must be detached from the paper slip stack by a burdensome chore such as of being cut with scissors, which involves the risk of causing the paper slip stack to slip out of the user's hand.

Besides, it is difficult to contain the paper slip stack in the paper holder while being kept in an orderly piled-up state until the paper slip stack reaches the bottom of the paper holder.

Furthermore, since the uppermost paper slip does not protrude through the paper drawing mouth of the paper holder merely by placing the paper slip stack into the paper holder, a burdensome chore of putting the user's finger or the like into the paper drawing mouth of the paper holder to take the paper slip out of the paper holder or pulling out the upper part of the paper slip with fingers and then closing a lid of the paper holder while lifting the upper part of the paper slip with the fingers when or after placing the paper slip stack into the paper holder is required.

In consideration of the above problems, the present invention provides a package for a paper slip stack, which can steadily and stably store the paper slip stack bundled by a packaging sheet and can be easily released from the packaging sheet after being contained in a paper holder.

Further the present invention seeks to provide a package for a paper slip stack, which can release the paper slip stack wrapped by a packaging sheet from the packaging sheet and contained in the paper holder with a paper drawing mouth when placing the wrapped paper slip stack into the paper holder and remove the packaging sheet through the paper drawing mouth in conjunction with being pulled from the upper part of the uppermost paper slip of the paper slip stack through the paper drawing mouth.

2. Means for Solving the Problems

To attain the objects described above according to the present invention, there is provided a package for a paper slip stack, characterized in that the paper slip stack is formed by alternately interlocking half parts of twofold paper slips with one another oppositely in their folded directions so as to be stacked in piles in their mutually interconnected state and bundled by a packaging sheet which is provided with a tab protruding outward from one side opposite to either of upper or lower surfaces of the aforesaid paper slip stack and a frangible part formed anywhere in a longitudinal direction of the packaging sheet so as to be cut or broken by a tensioning force produced by pulling the aforesaid tab.

According to the present invention, the paper slip stack can be stored in the steadily and stably bundled state by the packaging sheet so as not to unpile separately. Furthermore, the paper slip stack thus bundled steadily can be moved while being kept in its stacked state. The packaging sheet can easily be removed from the paper slip stack by making use of the frangible part which is capable of being cut or broken by the tensioning force produced by pulling the tab.

The present invention further provides a package for a paper slip stack, characterized in that the packaging sheet is equal in width to the paper slips constituting the paper slip stack.

According to the present invention, the packaging sheet having a width equal to that of the paper slips is capable of covering the entire surface of the paper slip stack more stably so as not to defile the paper slip stack.

The present invention further provides a package for a paper slip stack, characterized in that the packaging sheet is small in width relative to the paper slips constituting the paper slip stack.

According to the present invention, the packaging sheet having a width smaller than that of the paper slips makes it possible to diminish the requisite size of the packaging sheet to reduce production costs and easily cut the frangible (fragile) part with a small tensile force because the tensioning force produced by pulling the tab is concentrated onto the fragile part.

The present invention further provides a package for a paper slip stack, characterized in that the packaging sheet is made of synthetic-resin film.

According to the present invention, the packaging sheet of synthetic-resin film is tougher than paper or the like and hard to cut, but can be broken with ease by exerting a force on the frangible part.

The present invention further provides a package for a paper slip stack, characterized in that the packaging sheet is made of shrink film.

According to the present invention, the packaging sheet of shrink film allows the paper slip stack to be stably bundled by causing the packaging sheet to be wound around the paper slip stack and then shrunk so as to bring the packaging sheet into close contact with the paper slip stack.

The present invention further provides a package for a paper slip stack, characterized in that the tab is made by drawing outward a part of the packaging sheet wound around the paper slip stack to form a protrusion as an excess part, which is united with the packaging sheet.

According to the present invention, the tab can be formed as one part of the packaging sheet coinstantaneously at the time of bundling the paper slip stack.

The present invention further provides a package for a paper slip stack, characterized in that the tab is made of a small tab piece and formed by uniting one part thereof to the surface of the packaging sheet wound around the paper slip stack and raising the other part thereof.

According to the present invention, since the tab is made of the small tab piece, it can easily be formed in a desired shape or with the required strength. Besides, the tab can be attached later after bundling the paper slip stack with the packaging sheet.

The present invention further provides a package for a paper slip stack, characterized by applying an adhesive to one part of the back surface of the small tab piece, boring a through hole in one surface of the packaging sheet wound around the paper slip, which one surface is opposite to the upper or lower surface of the paper slip, and adhering the small tab piece to the aforesaid one surface with the adhesive applied partly to the back surface of the small tab piece while adhering the small tab piece to the half parts of the paper slip through the aforesaid through hole, to unite the aforesaid small tab piece to the aforesaid packaging sheet and the uppermost paper slip of the paper slip stack.

According to the present invention, since the small tab piece is adhered to the paper slip with the adhesive, the small tab piece and the half parts of the paper, which are raised when tearing off the frangible part by pulling the small tab piece, serve as an indicator for pulling the paper slip out of the paper holder.

The present invention further provides a package for a paper slip stack, characterized in that the frangible part is formed by a perforated line crossing the packaging sheet.

According to the present invention, the frangible part can easily be made by forming the perforated line crossing the packaging sheet.

The present invention further provides a package for a paper slip stack, characterized in that the frangible part is formed by arranging perforated lines crossing the packaging sheet in parallel at a required distance.

According to the present invention, since the frangible portion is formed by the perforated lines, the tolerance to a pulling force for cutting or breaking the frangible part can be broadened, so that adjustment for adequately cutting the frangible part by the pulling force can easily be performed, without the risk of breaking the frangible part by dropping the package.

The present invention further provides a package for a paper slip stack, characterized in that the perforated line is formed by continuously aligned incised portions and hookup portions, which each have a regular length.

According to the present invention, the perforated line formed by the continuously aligned incised portions and hookup portions, each having a regular length, can confer resistance to a tensioning force imparted to the perforated line, consequently to avoid careless breakage failure of the package.

The present invention further provides a package for a paper slip stack, characterized in that the perforated line is formed by continuously aligned incised portions and hookup portions, which each have an irregular length.

3. Effect of the Invention

Accordingly, as will be appreciated from the foregoing, the package of the present invention makes it possible to steadily and stably store a stack of paper slips in a bundled state. Moreover, since the frangible part of the packaging sheet can easily be torn off merely by pulling the tab so as to easily remove the packaging sheet from the paper slip stack.

To be more specific, when the package of the invention is contained in a paper holder having a paper drawing mouth, the tab capable of emerging from the paper drawing mouth allows the packaging sheet to be removed by pulling out the tab, while keeping the paper slip stack in the paper holder. In a case where the half parts of the tab and the paper slips are united with each other, the half part of the paper slip protrudes out of the paper holder through the paper drawing mouth, thus to facilitate pulling of the paper slip out of the paper holder.

EXPLANATION OF REFERENCE NUMERALS

| | |
|---|---|
| 1 | Package |
| 2 | Paper slip stack |
| 3 | Packaging sheet |
| 4 | Tab |
| 4a | Sticking portion |
| 4b | Pinch portion |
| 5 | Paper slip |
| 5a | Upper part of the paper slip |
| 5b | Lower part of the paper slip |
| 6 | Bottom of the package |
| 7 | Fragile cutting part |
| 8 | Perforation line |
| 8a | Incised portion |
| 8b | Hookup portion |
| 9 | Upper surface |
| 9a | Through hole |
| 10 | Adhesive |
| 11 | Paper holder |
| 11a | Hinge |
| 11b | Lid |
| 11c | Opening |
| 12 | Perforation line |
| 13 | Packaging sheet |
| 14 | Perforation line |
| 15 | Tab |
| 16 | Tab |
| 17 | Packaging sheet |
| 18 | Fragile cutting part |
| 19 | Perforation line |
| 19a | Incised portion |
| 19b | Hookup portion |
| 20 | Fragile cutting part |
| 21 | Perforation line |
| 21a | Incised portion |
| 21b | Hookup portion |
| 25 | Fragile cutting part |
| 26 | Perforation line |
| 26a | Incised portion |
| 26b | Hookup portion |
| 26c | Joint portion |
| 27 | Strip zone |
| 28 | Strip zone |
| 29 | Strip zone |
| 100 | Paper slip stack |
| 110 | Packaging sheet |
| 120 | Paper holder |
| 121 | Lid |
| 122 | Lifting plate |

DETAILED DESCRIPTION OF THE INVENTION

The accompanying drawings show embodiments of the present invention. A first embodiment of the invention is illustrated in FIG. 1 through FIG. 5.

Embodiment 1

Figure 1:
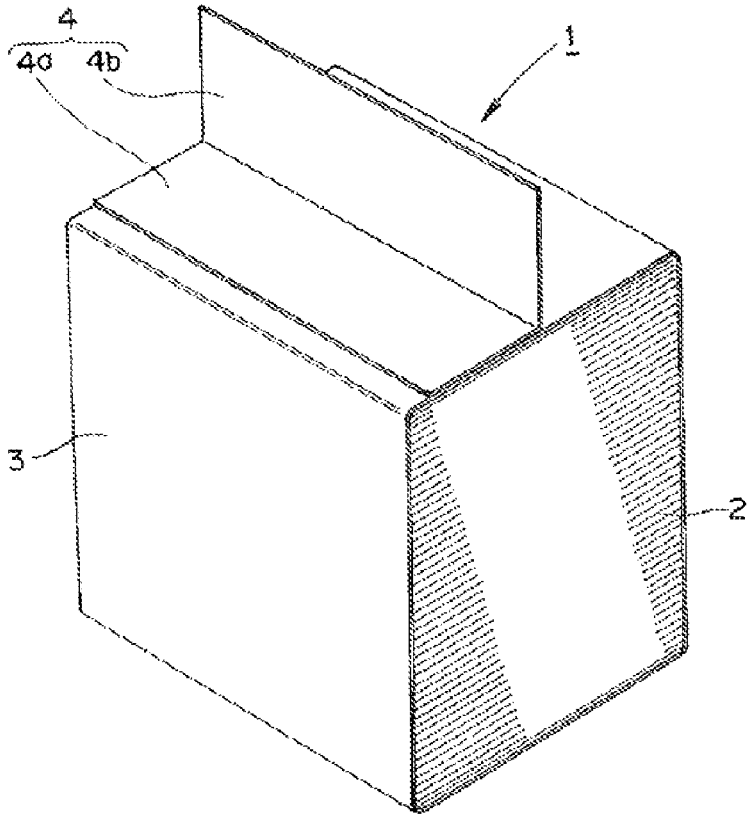
FIG. 1 is a perspective view showing a package constructed in accordance with a first embodiment of the invention.
Figure 2:
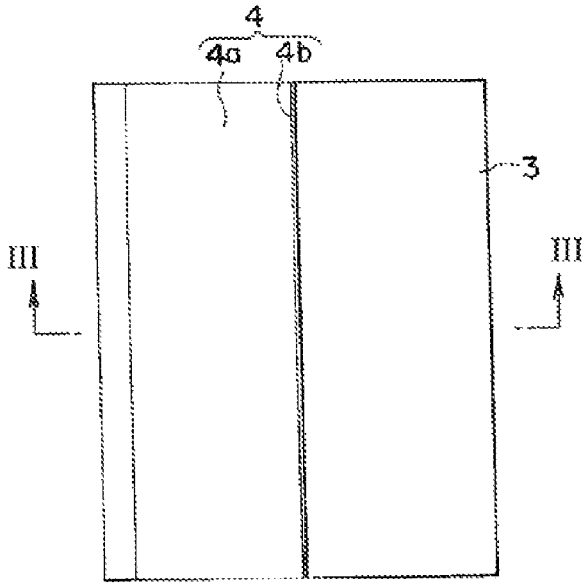
FIG. 2 is a plan view showing the package of the first embodiment of the invention.
Figure 3:
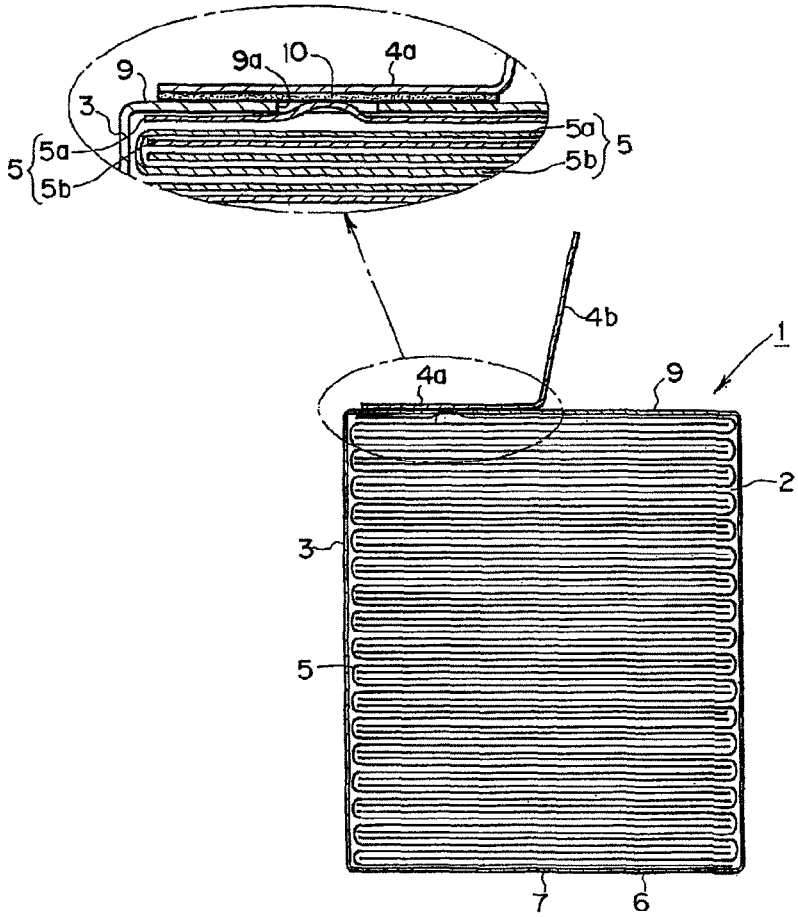
FIG. 3 is an enlarged cross sectional view taken along line III-III in FIG. 2.
Figure 4:
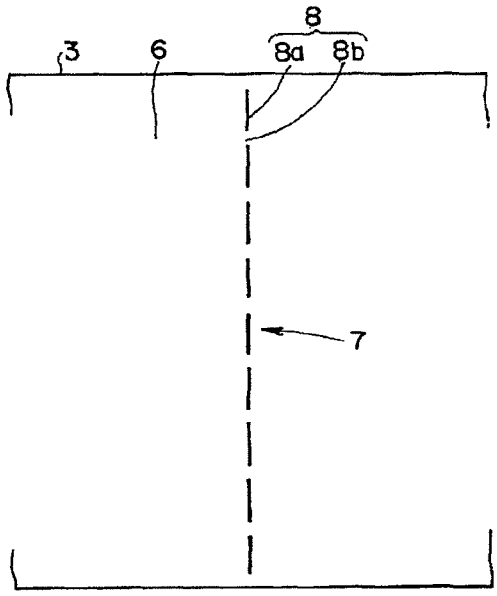
FIG. 4 is a bottom view showing the package of the first embodiment of the invention.
Figure 5:
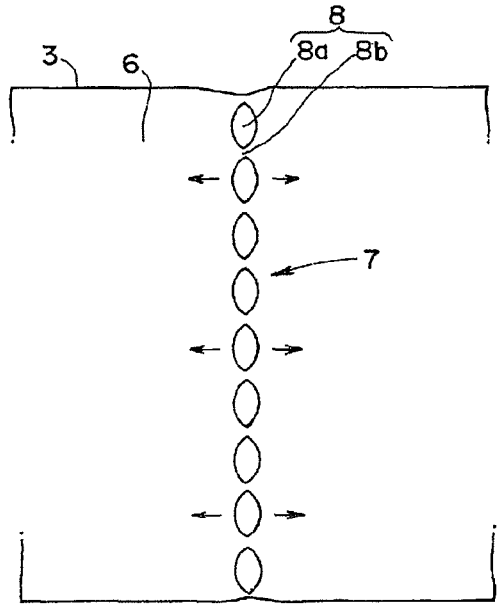
FIG. 5 is a bottom view illustrative of a process in which the package of the first embodiment is torn off.

FIG. 1 is a perspective view showing a package of Embodiment 1 of the invention. FIG. 2 is a plan view showing the package of Embodiment 1 of the invention. FIG. 3 is an enlarged cross sectional view taken along line III-III in FIG. 2. FIG. 4 is a bottom view showing the package of Embodiment 1 of the invention. Referring to the drawings, reference numeral 1 denotes a package, 2 denotes a paper slip stack as the content of the package, which is composed of a lot of paper slips in layers, 3 denotes a packaging sheet, 4 denotes a tab, and 7 denotes a fragile or frangible part.

The package 1 is composed of the packaging sheet 3 wound around the paper slip stack 2, and the tab 4 protruding outward from the packaging sheet 3.

As shown in FIG. 3, the paper slip stack 2 wrapped by the package 1 is formed by piling lots of twofold paper slips 5 in such a layered state that the paper slips 5 alternately interlock each other oppositely in their folded directions so as to allow half parts (upper parts 5*a* as one half parts and lower parts 5*b* as the other half parts) of the paper slips 5 to overlap each other. That is, the paper slips are interfolded by interposing the upper part 5*a* and the lower part 5*b* of one paper slip 5 on or under between the upper part 5*a* and lower part 5*b* of the other paper slip, so that the upper part 5*a* of the second paper slip of the paper slip stack 2 can be raised together by pulling up the uppermost paper slip 5 of the paper slip stack 2. The third and fourth paper slips are successively pulled out in the same manner.

The packaging sheet 3 serves to bundle the paper slip stack 2. The packaging sheet is wound around the paper slip stack and has substantially the same width as the paper slip stack 2. In this embodiment, the sheet stack 2 is bundled by causing a shrink film to be wound around the sheet stack 2 and heated to be shrunk. On the upper surface 9 of the packaging sheet 3, a tab 4 is attached to extend protrudingly upward.

The tab 4 is made by doubling a paper piece having a width according to that of the aforementioned packaging sheet 3. In this embodiment, one half of the doubled paper piece is adhered to the upper surface 9 of the packaging sheet 3 as a sticking portion 4*a*, and the other half rises as a pinch portion 4*b* for being pinched with the fingers of a user.

The sticking portion 4*a* is provided on its back with a seal applied with adhesive 10 so as to be adhered to the upper surface 9 of the packaging sheet 3 and stuck to the upper part 5*a* of the uppermost paper slip 5 through a through hole 9*a* bored in the upper surface 9 of the packaging sheet 3, to thereby join the paper slip 5 and the tab 4.

The tab 4 is required to have a strength so as not to at least be broken when tearing off a frangible part 7 to be described later. The adhesive 10 must have a strength so as to at least prevent the packaging sheet 3 from peeling off when tearing off the frangible part 7.

The tab 4 is made equal in width to the packaging sheet 3 in this embodiment, but it is not limited thereto and may be made smaller in width than the packaging sheet 3.

As shown in FIG. 4, the packaging sheet 3 has a perforated line 8 serving as the frangible part 7 formed across substantially the center of the bottom 6 thereof.

In this embodiment, the length of each incised portion (perforation) 8*a* of the perforated line 8 is made longer than that of each non-incised hookup portion 8*b*. The length of the hookup portion 8*b*, i.e. connection part, is determined so as not to be broken by an impact caused by dropping the package or with a force for pulling up the tab 4.

Next, usage of the package 1 will be described.

Figure 13:
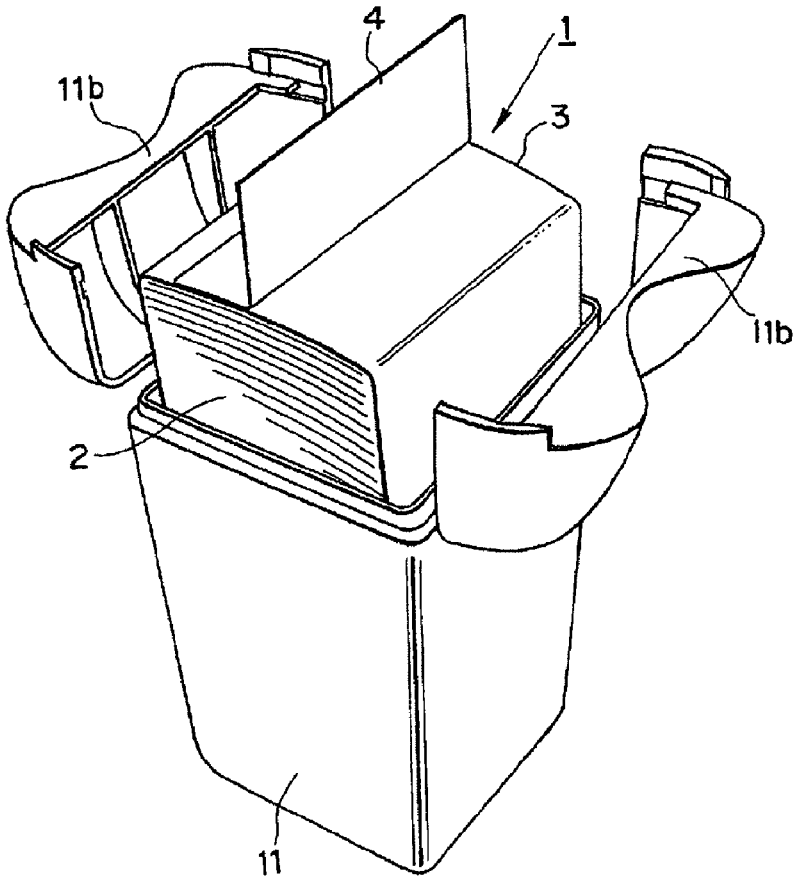
FIG. 13 is an explanatory perspective view showing a process in which the package of the invention is placed in a paper holder.
Figure 14:
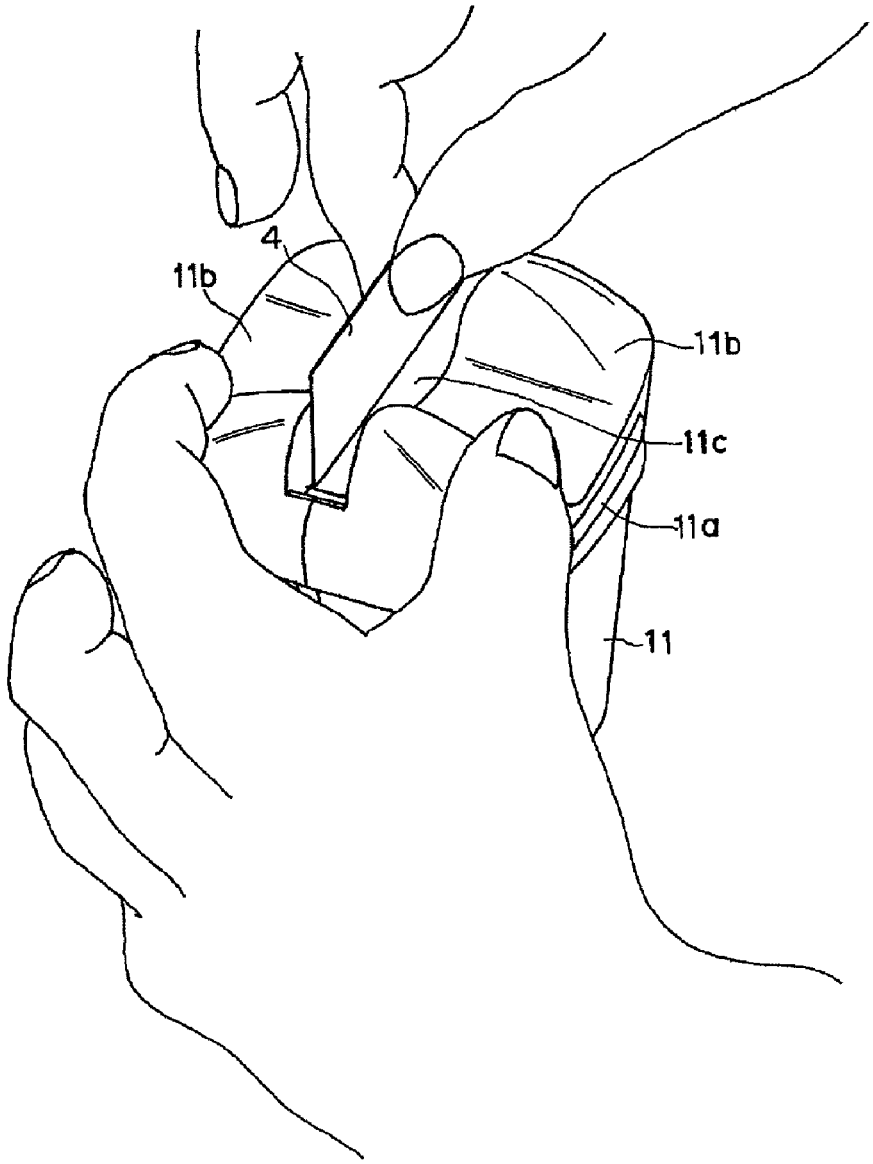
FIG. 14 is a perspective view illustrative of preparation for removing the packaging sheet by pulling the tab after placing the package of the invention into the paper holder.
Figure 15:
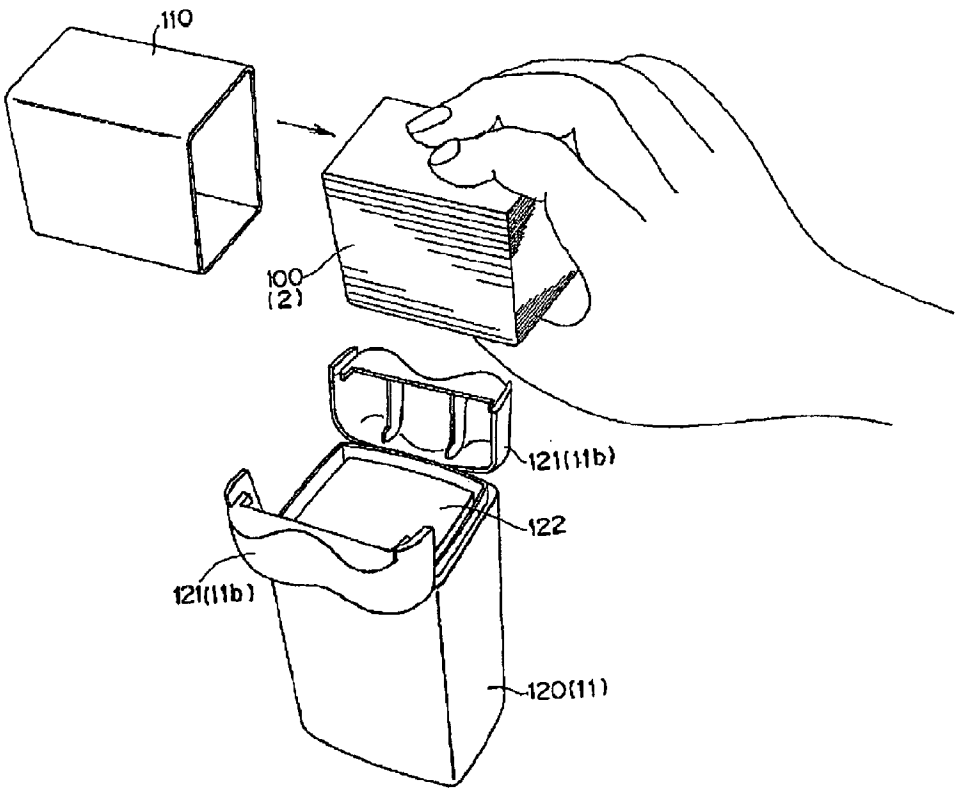
FIG. 15 (PRIOR ART)
FIG. 15 is a perspective view illustrative of handling of a conventional package.

FIG. 13 is a diagram showing a process in which the package 1 of this embodiment is placed in a paper holder 11, and FIG. 14 is a diagram showing the package 1 placed in the paper holder.

As illustrated, the paper slip stack 2 is used in the state in which it is contained in the paper holder 11. The paper holder 11 has right and left lids 11*b* and 11*b* that are openable around hinges 11*a*. By closing of the lids 11*b* and lib, there is formed a void space serving as a paper drawing mouth for paper slips 5 between the free ends of the lids, to thereby define an opening 11*c*.

A lifting plate (not shown), constantly urged upward by a spring, is disposed within the paper holder 11, so that the paper slip stack 2 is pushed up by the lifting plate as the paper slips of the paper slip stack 2 contained in the holder are pulled out in sequence.

The package 1 is contained in the paper holder 11 by allowing the paper slip stack 2 wrapt with the packaging sheet 3 just as it is to be inserted through the opening of the paper holder 11. Then, the lids 11*b* and 11*b* are closed. At this time, the tab 4 is held in its upright state between the lids 11*b* and 11*b* by confronting the lids with each other to define the opening 11*c*, so that the tab 4 protrudes out of the paper holder 11 through the opening.

As shown in FIG. 14, the packaging sheet 3 is removed from the package 1 placed in the aforementioned paper holder 11 by pulling up the tab 4 protruding through the opening 11*c* with the fingers of one hand, while pressing the lids 11*b* with the fingers of the other hand to prevent the lids from opening. This causes only the packaging sheet 3 to be pulled out while pressing the paper slip stack 2 with the lids 11*b* and 11*b*, so that a tensile shear force is spread to the frangible part 7, thus to progressively tear off hookup portions 8*b* by enlarging the incised portions 8*a* of the perforated line 8. Then, when all the hookup portions 8*b* are torn, the packaging sheet 3 is cut at its bottom and pulled out of the paper holder 11 through the opening 11*c* while being dragged by the tab 4.

At this time, since the upper part 5*a* of the uppermost paper slip 5 is adhered to the tab 4, the paper slip 5 is also pulled out through the opening 11*c* by pulling out the packaging sheet 3. As described above, the paper slip stack 2 is formed in a state of alternately interlocking the piled-up paper slips with each other, the upper part 5*a* of the second paper slip 5 emerges from the opening 11*c* by drawing out the uppermost paper slip 5, thus enabling consecutive drawing out of the paper slips 5.

As is apparent from the foregoing, the package 1 of the invention can be steadily and stably stored because the paper slip stack 2 is wrapped with the packaging sheet 3. When placing the paper slip stack in the paper holder, the paper slip stack 2 can be carried and put thereinto without peeling off the packaging sheet 3. Beside, only by pulling the tab 4 to tear the frangible part 7 of the aforementioned packaging sheet 3, the packaging sheet 3 can be removed leaving the paper slip stack 2 in a layered state within the paper holder.

To be specific, since the tab 4 extends above the packaging sheet 3 in the state of containing the package 1 in the paper holder 11, the tab 4 protrudes upward through the opening 11*c* upon putting the package into the paper holder 11. Thus, the packaging sheet 3 can be removed by pulling the tab 4 from outside while keeping the package contained in the paper holder 11. Also, since the tab 4 is adhered to the upper part 5*a* of the uppermost paper slip 5, the uppermost paper slip 5 can be pulled out by removing the packaging sheet 3, to prepare the subsequent paper slips for removal.

Figure 6:
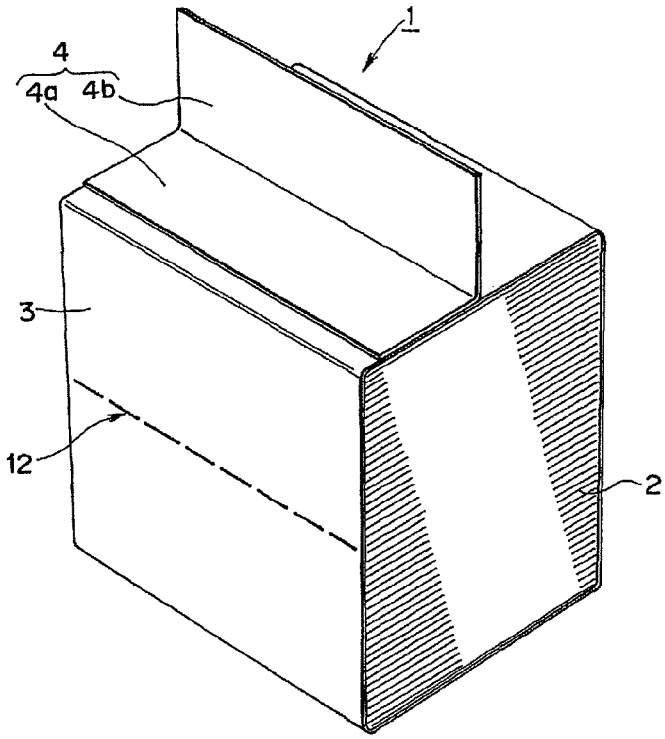
FIG. 6 is a perspective view showing the package of the first embodiment of the invention.

In this embodiment, the frangible part is made by the perforated line 8 formed across substantially the center of the bottom 6 of the packaging sheet 3, but is not limited to this structure and may be made by forming a perforated line 12 in the side surface of the packaging sheet 3 as shown in FIG. 6 as an example.

Since this frangible part is formed for the purpose of partly breaking the packaging sheet 3 to permit removal of the packaging sheet, it may be formed at a plurality of portions of the packaging sheet 3, so that the packaging sheet can be removed by tearing the packaging sheet at any of the frangible parts. Meanwhile, in the case of forming the frangible parts at multiple positions, they may be placed, for example, on both sides of the packaging sheet 3. Alternatively, in addition to the frangible part formed on the bottom 6 of the packaging sheet, another frangible part may be formed on the side of the packaging sheet. An additional frangible part may be formed along one side of the tab.

Embodiment 2

Figure 7:
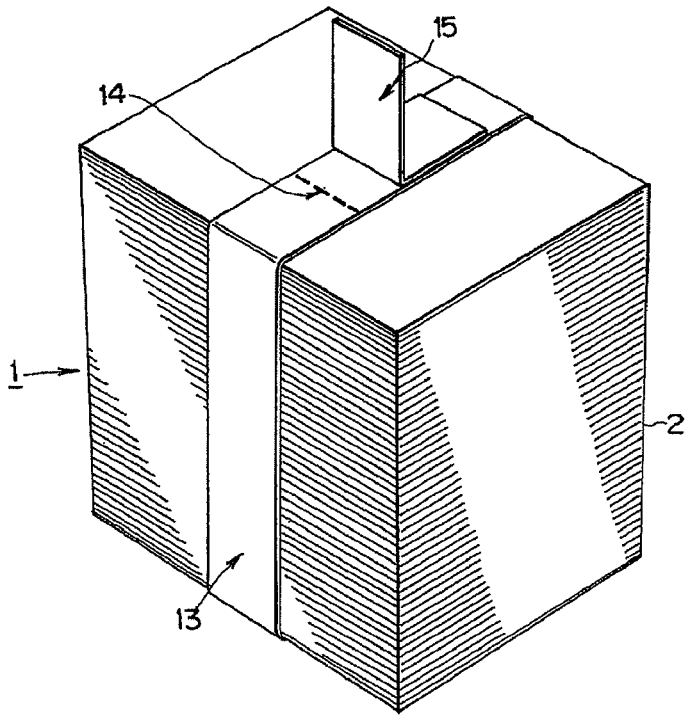
FIG. 7 is a perspective view showing a package constructed in accordance with a second embodiment of the invention.

Next, the second embodiment of the invention will be described with reference to FIG. 7. Although Embodiment 1 is related to the packaging sheet 3 which is made substantially equal in width to the paper slip stack 2, the packaging sheet 13 is made small in width to the paper slip stack 2 and a perforated line 14 constituting a frangible part is formed near a tab 15 as an example of this embodiment.

According to this structure, a tensioning force caused by pulling the tab 15 for removing the packaging sheet from the package 1 contained in the paper holder 11 is exerted directly to the perforated line 12, so that the perforated line 12 can easily be broken.

Embodiment 3

Figure 8:
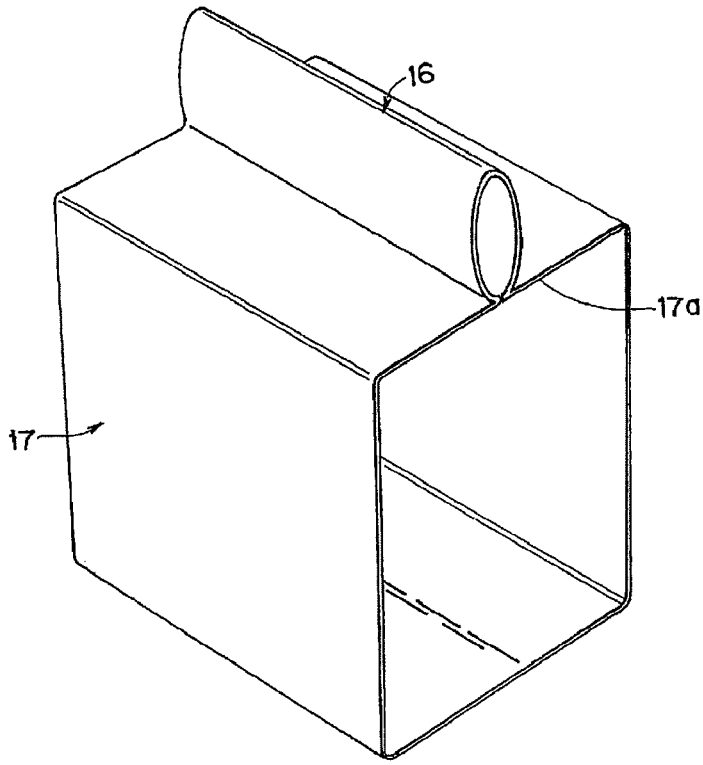
FIG. 8 is a perspective view showing a package constructed in accordance with a third embodiment of the invention.

Next, the third embodiment of the invention will be described with reference to FIG. 8. The paper slip stack is omitted from the drawing and illustration of the embodiment, but the configuration of the packaging sheet is specifically illustrated here.

In this embodiment, one part of a packaging sheet 17 protrudes upward as an excess part and is united with a tab 16. That is to say, the packaging sheet 17 is united to the tab by thermocompression bonding while slacking partly.

The tab 16 in this embodiment is made by the part of the packaging sheet 17 without using other elements such as a small tab piece, consequently to enable cost reduction.

Furthermore, unlike the case of using the small tab piece as the tab, the tab 16 can be composed in bundling the paper slip stack 2 with the packaging sheet.

Meanwhile, in the case of forming the tab 16 by one part of the packaging sheet 17 like this embodiment, the inner surface 17*a* of the packaging sheet is adhered directly to the upper part 5*a* of the uppermost paper slip 5 of the paper slip stack 2 to get ready for pulling out the paper slip 5 unlike the aforementioned embodiments.

Embodiment 4

Figure 9:
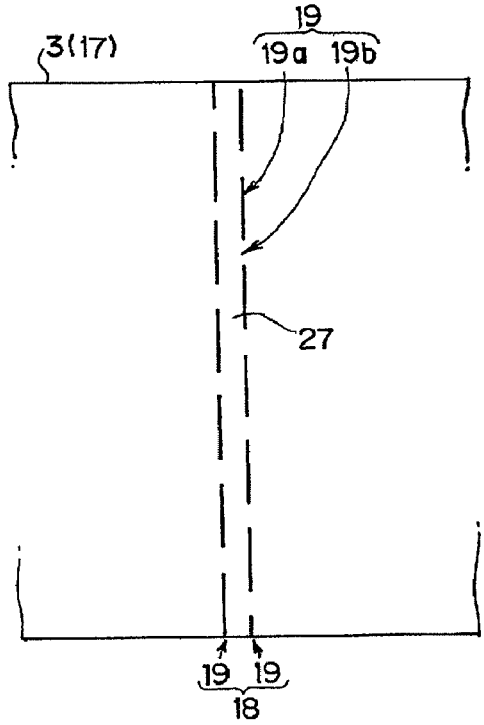
FIG. 9 is a bottom view showing a package constructed in accordance with a fourth embodiment of the invention.

Next, the fourth embodiment of the invention will be described with reference to FIGS. 9 and 10. This embodiment provides a modified frangible part. FIG. 9 shows the bottom of the package, and FIG. 10 is a bottom view illustrative of a process in which the package is torn off.

Unlike the first through third embodiments in which the frangible part is formed by the single straight perforated line, a frangible part 18 in this embodiment is formed by two straight perforated lines 19 arranged in parallel. Each perforated line 19 extends at constant length with a sequence of incised portions 19*a* and hookup portions 19*b*. The incised portions and hookup portions of the adjacent perforated lines 19 are arranged in a zigzag manner so that the respective incised portions 19*a* of one of the perforated lines 19 adjoiningly face the respective hookup portions 19*b* of the other perforated line 19.

Figure 10:
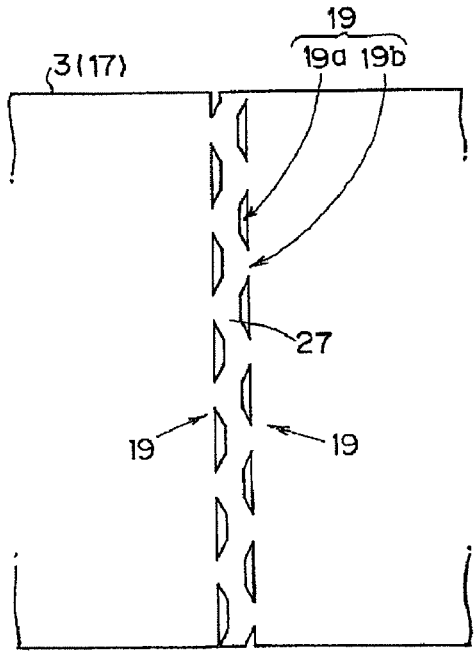
FIG. 10 is a bottom view illustrative of a process in which the package of the fourth embodiment is torn off.

As shown in FIG. 10, a strip zone 27 between the opposite incised portions 19*a* causes deformation due to spreading the incised portions 19*a*. The tearing of the packaging sheet is eventually fulfilled due to the deformation, thus to enable tearing with a soft feeling.

Further, the sequence of incised portions 19*a* and hookup portions 19*b* each having a regular length allows for easy design for the incised portions 19*a* and hookup portions 19*b* of each perforated line 19.

Embodiment 5

Figure 11:
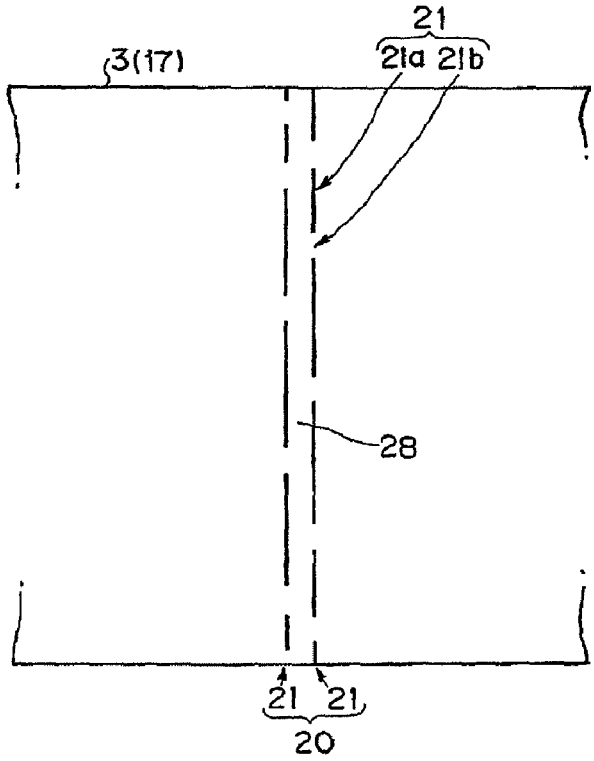
FIG. 11 is a bottom view showing a package constructed in accordance with a fifth embodiment of the invention.

Next, the fifth embodiment of the invention will be described. FIG. 11 shows the bottom of the package.

In this embodiment, a fragile cutting part 20 is formed by arranging in parallel two rows of perforated lines 21 on the bottom 6, each having continuously aligned incised portions 21*a* with irregular lengths.

The perforated lines 21 are formed in parallel as described so as to form a strip zone 28 therebetween, so that the strip zone 28 is eventually cut while being deformed in zigzag by undergoing a tensile force, consequently to tear off the respective hookup portions 21*b* at a time lag. The tearing of the hookup portions progresses smoothly in sequence.

The tearings are developed simultaneously over the entire perforated lines 21 to split off the frangible part 20 simultaneously.

Embodiment 6

Figure 12:
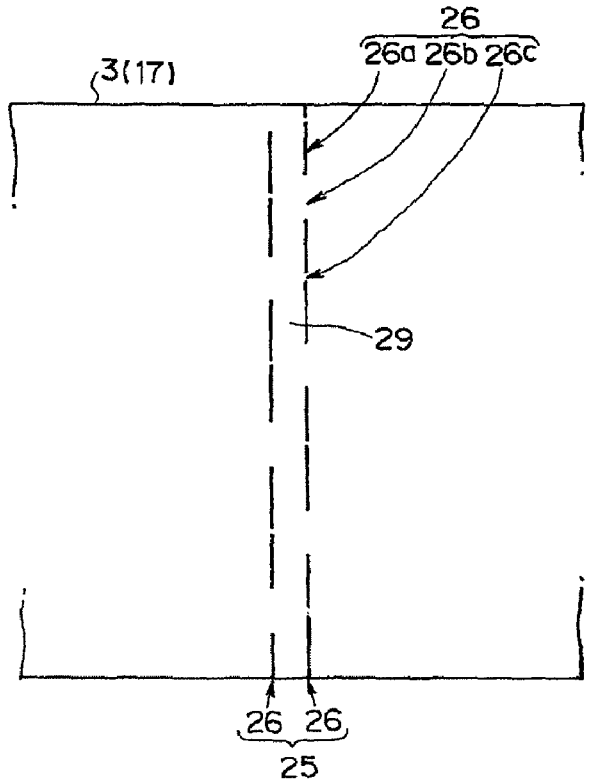
FIG. 12 is a bottom view showing a package constructed in accordance with a sixth embodiment of the invention.

Next, the sixth embodiment of the invention will be described. FIG. 12 shows the bottom of the package.

This embodiment is an example in which a frangible part 25 is formed by making fine joint portions 26*c* on the central parts of incised portions 26*a* of the perforation lines 26.

With the perforation lines 26, by pulling the tab 4 to impart a tensioning force to the packaging sheet 3, the short joint portions 26*c* are first broken and then strip zone 29 is subsequently cut while being deformed in zigzag, consequently to enable tearing with a more soft feeling. Thus, the joint portions 26*c* are broken without breaking hookup portions 26*b* by an impact caused by dropping the package or other causes, consequently to alleviate the impact.

There are described above the embodiments of the packages each having the tab disposed on the upper part as shown in each of the drawings and the opening farmed in the upper part, but the package of the invention is not limited to these structures and may have applicability to, for example, a package for paper towels of a wall-hanging type capable of pulling out the paper towels from its bottom.

INDUSTRIAL APPLICABILITY

The present invention is applicable to products including a stack of paper slips such as of tissue paper, paper towels and cold paper, which are interfolded and interconnected in such a layered state that lots of twofold paper slips alternately interlock with each other oppositely in their folded directions so as to allow half parts of the paper slips to overlap each other.

The invention claimed is:

1. A paper slip package comprising:

a paper slip stack formed by alternately interlocking half parts of a plurality of twofold paper slips with one another oppositely in folded directions of the paper slips so as to be stacked in a mutually interconnected state of the paper slips; and a packaging sheet wound around the paper slip stack, the packaging sheet being provided with a tab protruding outwardly from one side of the paper slip stack that is opposite to either of an upper surface or a lower surface of the paper slip stack, wherein the packaging sheet has a frangible part formed in a longitudinal direction of the packaging sheet, the frangible part being capable of being cut by a tensioning force produced by pulling the tab, and wherein the tab or the packaging sheet is adhered to the uppermost paper slip of the paper slip stack at the side provided with the tab.

2. The package as claimed in claim 1, wherein the packaging sheet is equal in width to the paper slips constituting the paper slip stack.

3. The package as claimed in claim 1, wherein the packaging sheet is small in width to the paper slips constituting the paper slip stack.

4. The package as claimed in claim 1, wherein the packaging sheet is made of synthetic-resin film.

5. The package as claimed in claim 1, wherein the packaging sheet is made of shrink film.

6. The package as claimed in claim 1, wherein the tab is made by drawing outward a part of the packaging sheet wound around the paper slip stack to form a protruding part, said protruding part being united with the packaging sheet.

7. The package as claimed in claim 1, wherein the tab is made of a small tab piece and formed by uniting one part thereof to the surface of the packaging sheet wound around the paper slip stack and raising another part thereof.

8. The package as claimed in claim 1, wherein an adhesive is applied to one part of the back surface of a small tab piece serving as the tab, a through hole is bored in one surface of the packaging sheet wound around the paper slip stack, said one surface being opposite to the upper or lower surface of the paper slip stack, and said small tab piece serving as the tab is adhered to said one surface with the adhesive applied partly to the back surface of the small tab piece while the small tab piece is adhered to the half parts of the paper slip through said through hole, to unite said small tab piece to said packaging sheet and the uppermost paper slip of the paper slip stack.

9. The package and paper slip stack as claimed in claim 1, wherein the frangible part is formed by a perforated line crossing the packaging sheet.

10. The package and paper slip stack as claimed in claim 1, wherein the frangible part is formed by arranging perforated lines crossing the packaging sheet in parallel, the perforated lines being spaced by a specified distance.

* * * * *